United States Patent [19]

Evans

[11] Patent Number: 4,948,379

[45] Date of Patent: Aug. 14, 1990

[54] SEPARABLE, SURFACE-MATING ELECTRICAL CONNECTOR AND ASSEMBLY

[75] Inventor: Robert F. Evans, Camp Hill, Pa.

[73] Assignee: E. I. du Pont de Nemours and Company, Wilmington, Del.

[21] Appl. No.: 324,940

[22] Filed: Mar. 17, 1989

[51] Int. Cl.[5] ..... H01R 9/07; H01R 9/09

[52] U.S. Cl. ..... 439/329; 439/466; 439/493; 439/498

[58] Field of Search ..... 439/67, 77, 329, 492–499, 439/466

[56] References Cited

U.S. PATENT DOCUMENTS

| | | | |
|---|---|---|---|
| 3,007,131 | 10/1961 | Dahlgren et al. | 439/492 |
| 3,873,173 | 3/1975 | Anhalt | 439/71 |
| 3,993,384 | 11/1976 | Dennis et al. | 439/71 |
| 4,072,387 | 2/1978 | Sochor | 439/329 |
| 4,468,074 | 8/1984 | Gordon | 439/296 |
| 4,628,410 | 12/1986 | Goodman et al. | 361/413 |
| 4,684,181 | 8/1987 | Massitt et al. | 439/59 |
| 4,770,645 | 9/1988 | Antes | 439/329 |
| 4,776,806 | 10/1988 | Adams | 439/67 |

*Primary Examiner*—Neil Abrams

[57] ABSTRACT

This invention relates to an electrical connector assembly. More specifically, it relates to an electrical connector and assembly and to a method for spatially configuring multiple connector assemblies on circuit-bearing substrates. The connector assembly is configured with a ramp on the upper surface of the connector housing to guide and support the flexible cable of one connector assembly over the housing of an adjacent connector so permitting a denser spatial arrangement of connector housings on a printed circuit board than could be previously achieved.

8 Claims, 4 Drawing Sheets

SEPARABLE, SURFACE-MATING ELECTRICAL CONNECTOR AND ASSEMBLY

FIELD OF THE INVENTION

This invention relates to an electrical connector. More specifically, it relates to an electrical connector and electrical connector assembly useful for the efficient spatial arrangement of electrical interconnections between circuit-bearing substrates.

DESCRIPTION OF THE RELATED ART

The trend in circuit board design has been towards fitting more and more electrical circuitry in smaller and smaller areas. Connector assemblies are used to interconnect printed circuit boards or similar substrates. Known connector assemblies are unsuitable where circuit board space is limited or a specific design is required. In certain cases the most space-efficient placement of connector assemblies between particular circuit boards is prevented by the obstructing design of the connector assemblies currently available.

One type of known connector assembly uses multi-wire flexible cables. A multi-wire flexible cable is a substantially flat means for carrying electrical current. Current is carried from one end of the multi-wire flexible cable to the other along its length by many parallel conductors. Although a multi-wire flexible cable is somewhat bendable along its length, it may not bend sufficiently to permit a desired configuration of multiple assemblies without damage to the parallel conductors or to contact connections enclosed in connector housings at either end of each multi-wire flexible cable. Furthermore, known assemblies with multi-wire flexible cables exiting horizontally from a connector obstruct placement of a neighboring connector assembly. As a result of the obstruction, the surface area of the circuit board is not used efficiently, design flexibility is limited, and the maximum density of electrical connections is not achievable. Pressure to remove these limitations are felt in the industry as illustrated by the following existing art.

Connectors are known having a multi-level terminal block retaining multiple rows of contacts. Dahlgren et al. (USP 3,007,131) show the use of a multi-level terminal block for use with a multi-wire flexible cable. The multi-level arrangement permits an increased density of contacts per assembly. However, Dahlgren et al teach nothing about a housing for the terminal block that solves the problem of how to arrange a number of terminal blocks for maximum density on a circuit board.

Massitt et al. (USP 4,684,181) disclose a terminal block enclosed by a connector housing with a horizontal opening for multi-wire flexible cables. This patent discloses multiple flexes attached at each end to respective levels of a multi-level support within a connector. The deficiency that is readily apparent in this device is that the side-exiting multi-wire flexible cable obstructs placement of a second identical connector positioned immediately side-by-side to the first. Therefore, the surface area needed to position the connectors cannot be less than a certain area without damage to the multi-wire flexible cables.

Adams (USP 4,776,806) discloses a low profile connector with a horizontal exit from the housing for a flexible cable. The "low-profile" feature of Adams guides a flexible cable over longitudinally aligned connectors. This design is useful for decreasing the space needed between separate circuit boards to accommodate connector assemblies connected to circuit-bearing substrates in a single plane. However, it does not permit the high density of contacts possible with multiple flexible cables associated with a single connector assembly.

Applicant's invention solves all of these difficulties with an electrical connector permitting the immediate side-by-side placement of high density electrical assemblies. Applicant's connector is designed with a housing containing a terminal block which may be multi-tiered for use with multi-wire flexible cables. The housing has a ramp and a chute on opposing sides. By placing two connectors so that the chute of the first connector is aligned with the ramp of the second connector, a flexible cable emerging from the first connector is not obstructed by the second connector, but instead is directed over the second connector by means of the ramp. This positioning of connectors is what is meant by the phrase "angled chute-to-ramp relationship."

The proximity of the two connectors in this "angled chute-to-ramp relationship" may be so close that they touch. Thus, positioning of connectors on circuit-bearing substrates more densely than with previously known connectors is possible. In addition, damage to multi-wire flexible cables is prevented. This result is obtained by using in combination as specified below a connector housing with a multi-level terminal block for retaining contacts which are attached to the ends of the multi-wire flexible cable conductors.

SUMMARY OF THE INVENTION

In accordance with the instant invention, an electrical connector is provided for connecting an electrical circuit-bearing substrate with a multi-wire flexible electrical cable having a plurality of parallel conductors across its width, the connector including:

- a connector housing in the form of a parallelipiped having a ramp joining a first face and a second face by truncating one corner of the connector housing, the parallelipiped having an internal cavity, the internal cavity accessed through an opening in a third face of the connector housing opposite to the first face of the connector housing, the internal cavity also accessed through an angled chute in a fourth face opposite to the second face of the connector housing, the angled chute of such dimensions to permit passage of a multi-wire flexible cable into the internal cavity, the angle of the ramp and the angle of the chute being about the same as measured with respect to the third face of the connector housing, and the distance from the third face to the chute on the fourth face corresponding to the distance from the third face to the ramp on the second face;
- a terminal block positioned within the internal cavity and adapted for attachment to one end of a flexible cable;
- an array of electrical contacts supported by the terminal block, one end of the contacts protruding from the terminal block and extending through the opening in the third face for engagement with the electrical circuit-bearing substrate, the other end of the contacts protruding from the terminal block for attachment with one end of the multi-wire flexible cable.

BRIEF DESCRIPTION OF THE DRAWINGS

The invention can be more fully understood from the following detailed description thereof in connection with accompanying drawings which form a part of this application and in which similar reference numerals refer to similar elements in all figures of the drawings.

DESCRIPTION OF THE PREFERRED EMBODIMENTS

Figure 1:
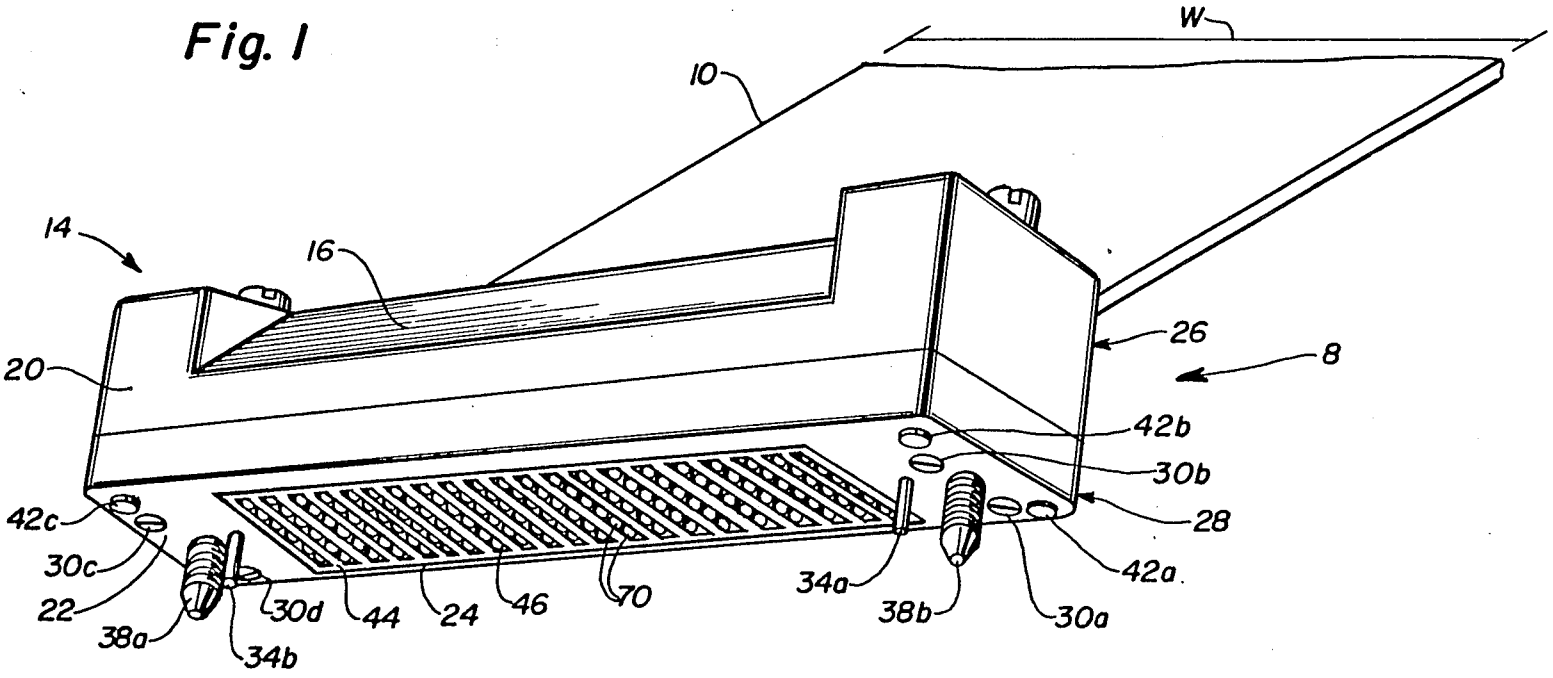
FIG. 1 is a perspective view looking upwardly toward the electrical contact side of a connector of the circuit assembly in accordance with the instant invention.

FIG. 1 represents a connector of the present invention designated generally therein by the reference character 8. As shown, connector 8 terminates the end of a multi-wire flexible cable 10 of the type having a plurality of parallel conductors 12 across its width W. The connector 8 includes a connector housing 14 in the form of a parallelipiped and contains various sub-components described more fully below in relation to FIGS. 2, 3, 4 and 5. The connector housing 14 has a ramp 16 joining a first face 18 and a second face 20 by truncating one corner of the connector housing 14, and a third face 22 defining an opening 24. The connector housing 14 is divided into a first housing piece 26 and second housing piece 28 which enclose one end of multi-wire flexible cable 10. First housing piece 26 includes ramp 16. Second housing piece 28 includes opening 24. Housing pieces 26 and 28 are formed of suitable materials such as die-cast zinc or aluminum and are held together with fastening means such as joining screws 30. Connector 8 is oriented on a circuit-bearing substrate 32 with positioning means such as guide pins 34 which fit into recesses 36. Once positioned, fastening means such as jack screws 38 are tightened into threaded apertures 40 in the circuit-bearing substrate 32 to secure connector 8. Deflection supports 42 cushion the housing upon attachment of the connector 8 to the circuit-bearing substrate 32.

FIG. 1 further illustrates the spacer comb 44 which is supported within the opening 24 of the second housing piece 28. Spacer comb 44 is made of suitable materials, preferably a nonconductive polyester material, and has a plurality of through passages 46.

Figure 2:
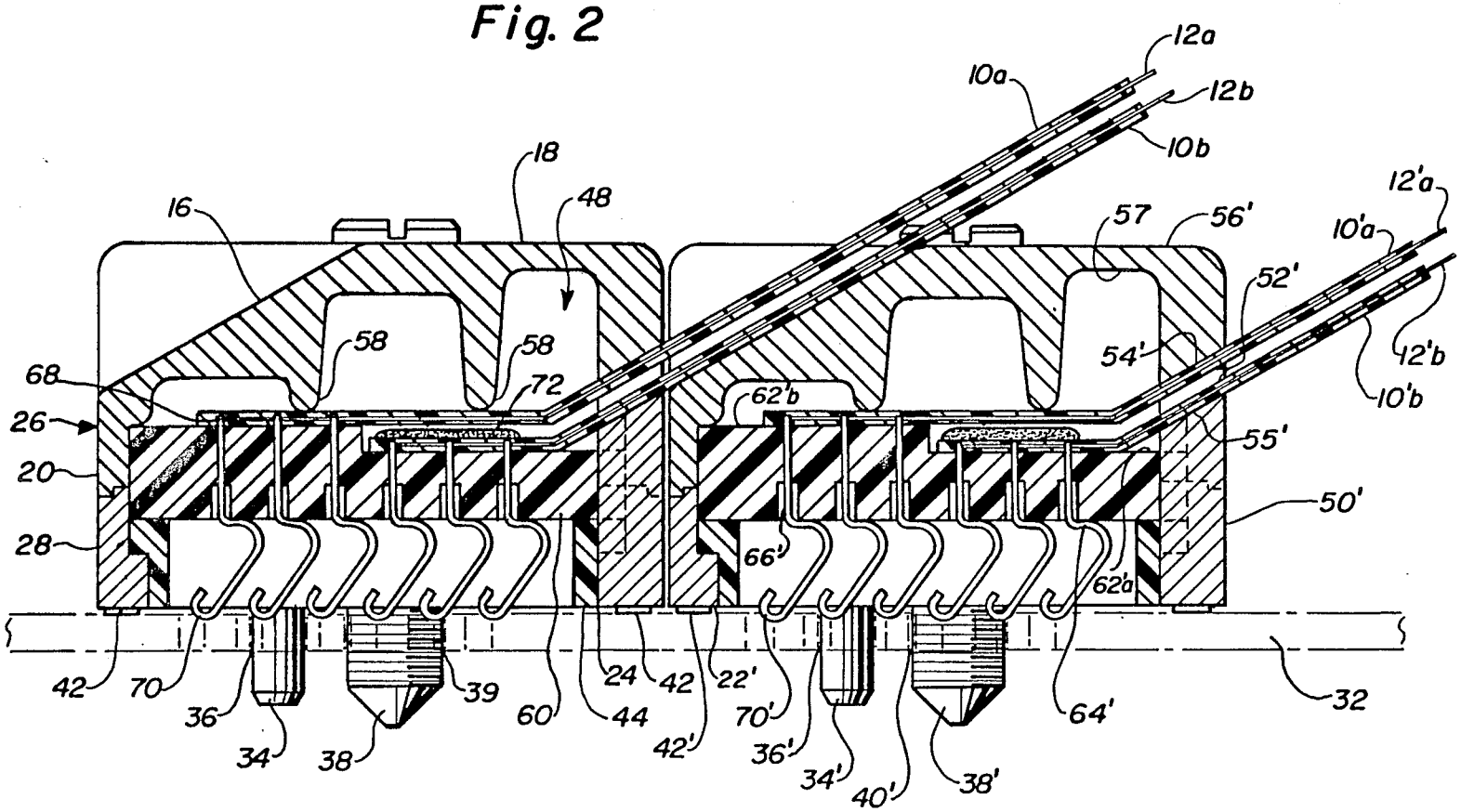
FIG. 2 is an enlarged sectional view through a central portion of two connectors of separate assemblies illustrating an angled chute-to-ramp relationship of the connectors in normal operative position in accordance with the instant invention.

FIG. 2 illustrates, in accordance with the present invention, an enlarged sectional view through the central portion of two substantially similar connectors 8 and 8'.

Figure 3:
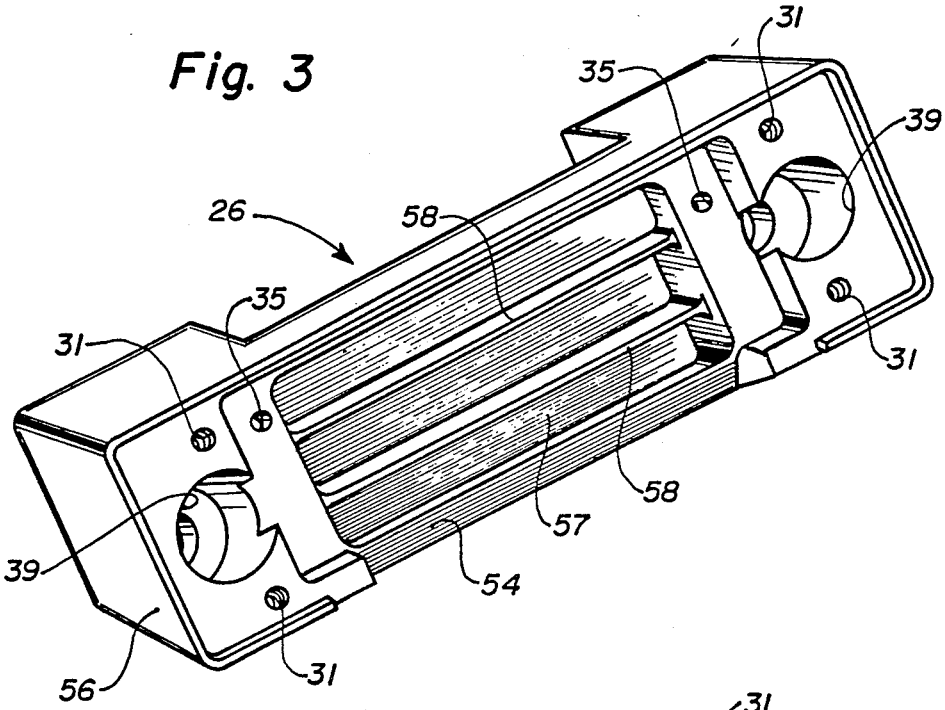
FIG. 3 represents a perspective view looking upwardly toward the gripping planes and the pedestal supports of the first piece of the connector housing in accordance with the instant invention.

In FIG. 2, first housing piece 26 and second housing piece 28 are joined to form internal cavity 48. The fourth face 50 of the connector housing 14 includes an angled chute 52 which is defined by gripping planes 54 and 55 running between the exterior wall 56 and the interior wall 57 of the connector housing 14. Within the internal cavity 48, the first housing piece 26 includes pedestal supports 58 which brace the end of the multi-wire flexible cable 10 against the load generated as the connector 8 is mounted on the circuit-bearing substrate 32. FIG. 3 shows in a perspective view the interior wall 57 of the first housing piece 26 with pedestal supports 58. In other embodiments of the instant invention, the number of pedestal supports 58 corresponds to the number of multi-wire flexible cables 10 terminating in a connector 8. Other means for bracing the multi-wire flexible cable 10 are also encompassed within Applicant's invention.

The connectors 8 and 8' are shown in FIG. 2 in the normal operative position of a chute-to-ramp relationship. By "chut-to-ramp relationship" Aplicant means that the chute 52 of connector 8 fits immediately adjacent to the ramp 16' of connector 8', permitting the multi-wire flexible cable 10 to exit from chute 52 without obstruction. The ramp 16 and chute 52 permit the correct spatial relationship of neighboring connectors 8 so that there are no deforming stresses or pressures on elements of the invention produced by the geometry of the connector configuration on the circuit-bearing substrate 32. The mulit-wire flexible cable 10 of connector 8 is instead guided over the connector 8' by the ramp 16'. The angle and direction of the ramp 16' and the angle and direction of the chute 52 are substantially the same when measured with reference to the third face 22 of the connector housing 14. By "substantially the same" Applicant means that the angle and the direction of these elements differ with respect to immediately adjacent connectors 8 by no more than 20 degrees. The angle accommodates the number of the levels 62 of the terminal block 60' and the total height of the connector 8'. Additionally, the height of chute 52 from the third face 22 corresponds to the height of ramp 16' from the third face 22'. By "corresponds" Applicant means that the height of the chute 52 and the height of the ramp 16' are such that the chute-to-ramp relationship of the connectors 8 and 8' is maintained.

FIG. 2 additionally shows spacer comb 44 supporting terminal block 60 within the connector housing 14. The terminal block 60 is formed of a suitable non-conductive material such as polyetherimide or liquid crystal polymer. In the embodiment shown in FIG. 2, the terminal block 60 has a tiered surface with two levels or stepts **62*a* and 62*b*, each level 62 to support the attachment of one end of a multi-wire flexible cable 10. By "tiered" Applicant means that the terminal block has more than one level arranged in steadily ascending order. Other embodiments of the instant invention may have a terminal block 60 with a single level 62 or with multiple levels 62*a–n*, the number of levels 62 of any terminal block 60 corresponding to the number of multi-wire flexible cables 10 received into the chute 52**.

The terminal block 60 retains contacts 64 in a plurality of through passages 66. The contacts 64 are made of a suitable material such as beryllium copper. The contacts 64 may include suitable forms such as a pin-and-spring, cylindrical, triple beam, square pins, blade and bifurcated fork type, and other contact types. The pin-and-spring type of contact 64 is illustrated in FIG. 2, the pin end 68 protruding from the tiered surface of the terminal block 60 into the internal cavity 48 of the connector housing 14 for attachment to a corresponding conductor 12 of a multi-wire flexible cable 10. One embodiment of the present invention has a multi-wire flexible cable with parallel conductors 12 between laminae (not illustrated) made of a polyimide and ground planes (not illustrated) preferably made of a silver epoxy. The spring end 70 of each contact 64 protrudes from the opposite side of the terminal block 60 through opening 24 for contact with the circuit-bearing substrate 32. The spacer comb 44 protects the contacts 64 from damage upon attachment of the connector 8 to a circuit-bearing substrate 32.

The contacts 64 are organized in a subarray of rows and columns (unnumbered) of alternating signal and ground contact pairs with a ground column preferably in the outside or end position. Each contact column is separated from an adjacent column by a suitable distance. Each contact row is separated from an adjacent row by a suitable distance. The contacts 64 are further arranged so that one subarray of contacts 64 is retained in each level 62 of the terminal block 60 as illustrated in FIG. 2. A subarray of contacts 64 is attached at their pin end 68 by known means to the conductors 12 of the corresponding multi-wire flexible cable 10. The circuit-bearing substrate 32 contains conductive traces (not shown) aligned for connection with contacts 64.

Figure 4:
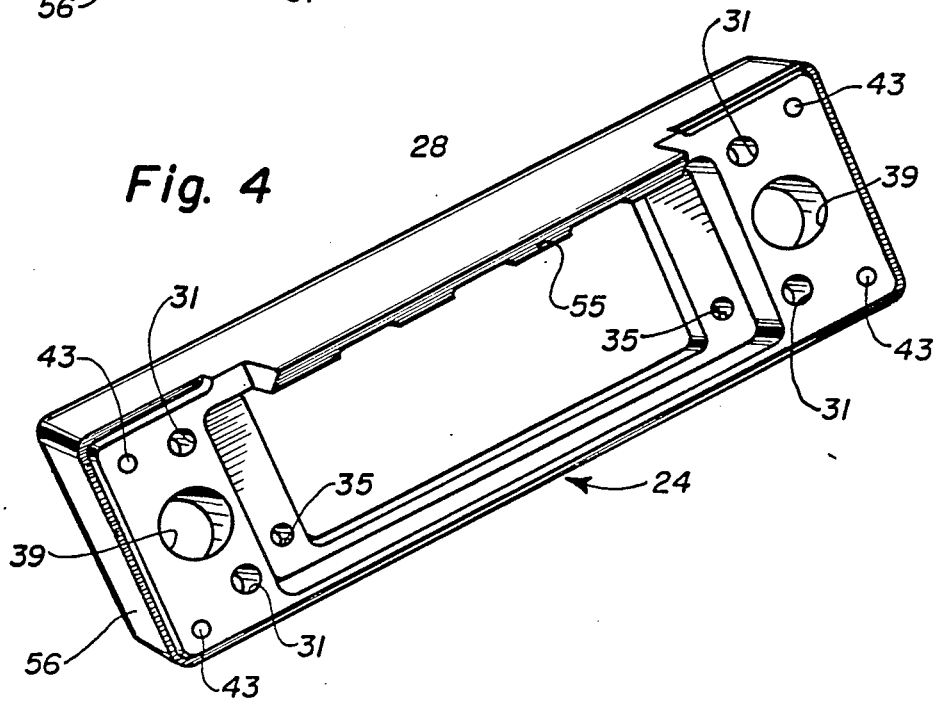
FIG. 4 represents a perspective view looking downwardly toward the gripping planes and the opening of the second piece of the connector housing in accordance with the instant invention.

A separator 72 is positioned over the joining of the contact pin end 68 with the multi-wire flexible cable 10 to protect an adjacent multi-wire flexible cable 10 from damage during handling, placement, and connection to the circuit-bearing substrate 32. The separator 72 also protects the joining of the pin end 68 and the multi-wire flexible cable 10 from damage. FIGS. 3 and 4, respectively perspective views of the interior wall 57 of the first housing piece 26 and second housing piece 28, also illustrate the placement of various passages in the connector housing 14. Jack screw 38 fits through passage 39 for securing into threaded aperture 40 in the circuit-bearing substrate. Joining screws 30 are introduced into threaded housing apertures 31 in the first housing piece 26 and the second housing piece 28. Guide pins fit into cylindrical spaces 35 in the first housing piece 26 and the second housing piece 28. The end of the guide pin 34 which protrudes from the third face 22 of the connector 8 fits into the substrate recess 36. Deflection supports 42 fit into recesses 43 in the third face of the connector housing 14. FIGS. 3 and 4 also show gripping planes 54 and 55 which guide the multi-wire flexible cable as it exists from the connector housing 14.

In the preferred embodiment of the instant invention, the number of levels 62 on the terminal block 60 equals the number of multi-wire flexible cables 10 received into the chute 52 and also equals the number of pedestal supports 58 of each connector. The distance between gripping planes 54 and 55 of chute 52 is at least as thick as the thickness of the total number of multi-wire flexible cables 10 received by associated connector 8.

Figure 5:
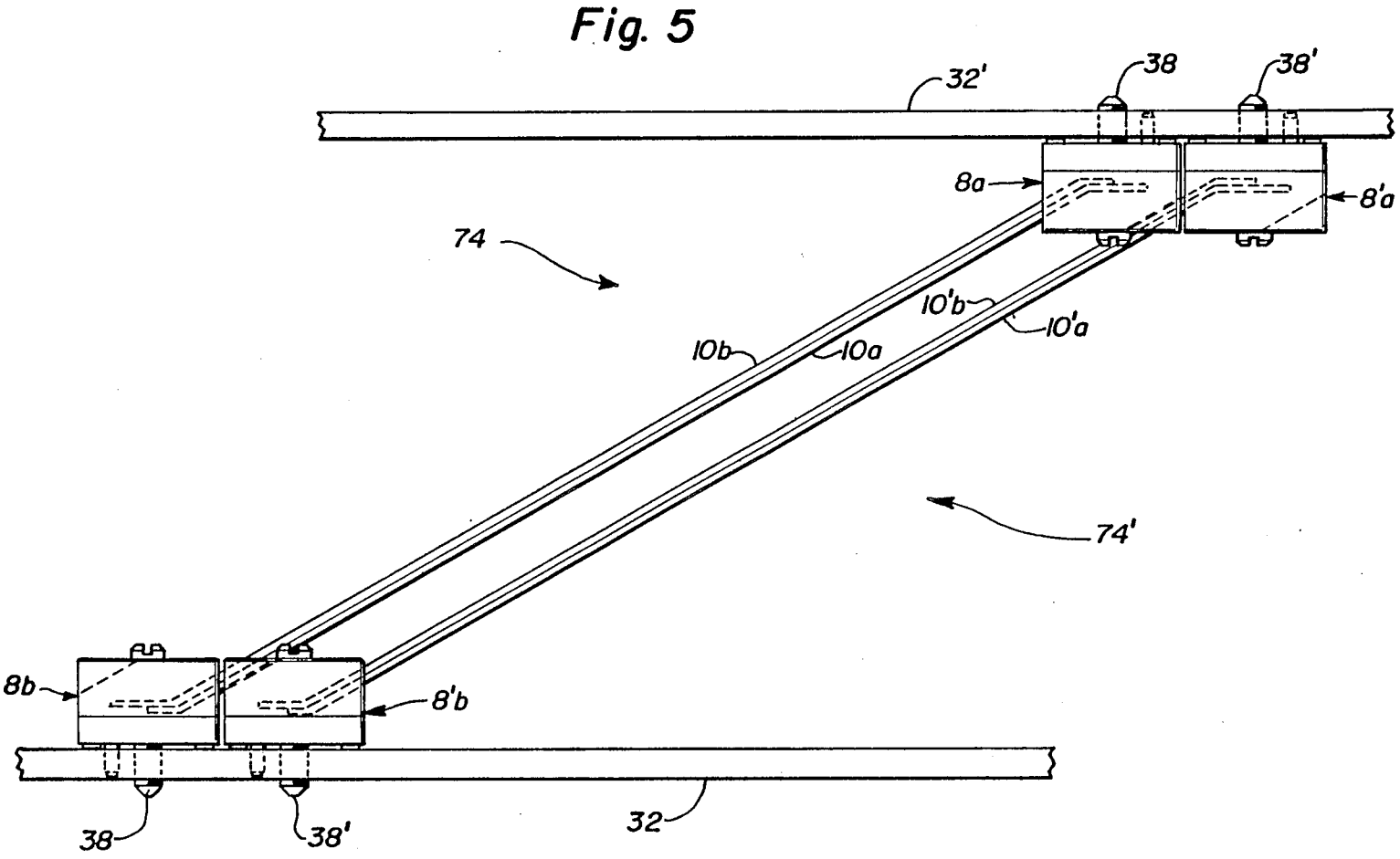
FIG. 5 represents a side elevation view of two assemblies in an angled chute-to-ramp relationship secured to circuit-bearing substrates in accordance with the instant invention.

Two electrical assemblies in accordance with the instant invention are shown in FIG. 5 and designated generally therein by the reference characters 74 and 74'. As shown, assembly 74 includes at least one multi-wire flexible cable 10 connected at each end to a connector 8. The length or the direction of the flexible cable 10 can be altered to offset the placement of the connector 8 at each end of the flexible cable 10. This feature also enhances variety in design of assembly configurations. Assembly 74' fits immediately side-by-side with assembly 74 efficiently using space for the stacking of the assemblies. FIG. 5 also illustrates how the ramp 16 of the connector 8 permits the unobstructed exit of the multi-wire flexible cable 10 from connector 8'. The width dimension of the ramp 16 is larger than the cross section width dimension W of the flexible cable 10. The ramp 16 supports and guides the flexible cable 10 in immediate side-by-side configurations of the connectors 8 of the present invention FIG. 5 illustrates how assemblies 74 and 74' may interconnect the circuit-bearing substrates 32 and 32' which are in two different planes. Assemblies may also interconnect circuit-bearing substrates in the same plane.

Those skilled in the art, having the benefit of the teachings of the present invention as described, can effect numerous modifications thereto. These modifications are to be construed as being encompassed within the scope of the present invention as set forth in the appended claims. accommodate a flex on each step.

I claim:

1. An electrical connector for connecting an electrical circuit-bearing substrate with a multi-wire flexible electrical cable having a plurality of parallel conductors across its width, the connector comprising:

a connector housing in the form of a parallelipiped having a ramp joining a first face and a second face by truncating one corner of the connector housing, the parallelipiped having an internal cavity, the internal cavity accessed through an opening in a third face of the connector housing opposite to the first face of the connector housing, the internal cavity also accessed through an angled chute in a fourth face opposite to the second face of the connector housing, the angled chute to such dimensions to permit passage of a multi-wire flexible cable into the internal cavity, the angle of the ramp and the angle of the chute being about the same as measured with respect to the third face of the connector housing, and the distance from the third face to the chute on the fourth face corresponding to the distance from the third face to the ramp on the second face;

a terminal block positioned within the internal cavity and adapted for attachment to one end of a flexible cable;

an array of electrical contacts supported by the terminal block, one end of the contacts protruding from the terminal block and extending through the opening in the third face for engagement with the electrical circuit-bearing substrate, the other end of the contacts protruding from the terminal block for attachment with one end of the multi-wire flexible cable;

whereby a plurality of such connector housings could be located adjacent one another so that the ramp of one such connector housing acts to guide and support the flexible cable of another such connector housing.

2. The connector housing of claim 1, wherein the angled chute is dimensioned to permit passage of multiple flexible cables into the internal cavity, and the terminal block is tiered for attachment of each flexible cable to a separate step.

3. A series of electrical connectors comprising two or more of the connectors of claim 1 being placed in adjacent, angled chute-to-ramp relationship on an electrical circuit-bearing substrate.

4. The electrical connector of claim 1 wherein a spacer comb is located within the internal cavity.

5. The electrical connector of claim 1, wherein the connector housing comprises a first piece and a second piece joined together to define the internal cavity, the first piece including the first face, the ramp, part of the second face, and the upper portion of the fourth face, and the second piece including the third face, the remainder of the second face, and a lower portion of the fourth face.

6. The connector of claim 1, wherein the chute comprises an array of gripping teeth.

7. The connector housing of claim 1, wherein the first piece has a pedestal support directed into the internal cavity, the pedestal support having a width approximately as wide as and running traverse to the multi-wire flexible cable so that the pedestal support braces the multi-wire flexible cable and the terminal block and counters the load generated upon the securing of the connector to a circuit substrate.

8. An electrical connector assembly for interconnecting electrical circuit-bearing substrates comprising:

a multi-wire flexible cable having a plurality of parallel conductors across its width; and a connector as set forth in claim 1 attached at each end of the multi-wire flexible cable.

* * * * *